US006232863B1

(12) United States Patent
Skinner et al.

(10) Patent No.: US 6,232,863 B1
(45) Date of Patent: May 15, 2001

(54) SPOOL ASSEMBLY FOR AN IGNITION COIL

(75) Inventors: Albert Anthony Skinner, Anderson; Mark Albert Paul, Fishers; Viorel N. Moga, Anderson; Paul G. Knight, Markleville, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/519,040

(22) Filed: Mar. 3, 2000

(51) Int. Cl.[7] ..... H01F 27/02; H01F 27/28

(52) U.S. Cl. ..... 336/96; 336/225; 336/222; 336/182; 336/198

(58) Field of Search ..... 336/182, 96, 198, 336/275, 190, 222

(56) References Cited

U.S. PATENT DOCUMENTS 5,929,736 7/1999 Sakamaki et al. ..... 336/96

FOREIGN PATENT DOCUMENTS

0750324A2 12/1996 (EP) .

*Primary Examiner*—M. L. Sellner
*Assistant Examiner*—Minh Nguyen
(74) *Attorney, Agent, or Firm*—Margaret A. Dobrowitsky

(57) ABSTRACT

An ignition coil for a spark ignition engine generally includes primary and secondary windings disposed about a magnetic core. The secondary winding is wound around a spool. The spool includes a cylindrical body having opposite first and second ends and a winding section between the ends. A conical winding surface at one of the ends tapers from a large diameter at the one end to a smaller diameter. A grooved surface extends axially toward another of the ends of the body and extends to adjacent the smaller diameter of the conical surface. The grooved surface contains longitudinally spaced continuous circular grooves that have unequally angled sides. The sides toward the one end are sloped at a greater angle relative to a radial direction than are the sides toward the other end. The secondary winding is wound around the winding section forming a plurality of turns of wire wound one over the other at a desired angle. The grooves are sized such that only one turn of the wire is disposed within each groove.

7 Claims, 2 Drawing Sheets

SPOOL ASSEMBLY FOR AN IGNITION COIL

TECHNICAL FIELD

This invention relates to ignition coils for spark ignition engines, and more particularly to an ignition coil having a spool that has generally sawtooth shaped grooves to reduce wire slippage of the winding.

BACKGROUND OF THE INVENTION

It is well known in the art of ignition systems for automotive vehicles to have an ignition coil that produces a magnetic energy upon discharge to create a high voltage spark for initiating combustion in an engine cylinder. Typically, the ignition coil includes primary and secondary windings each wound around a spool and disposed about a magnetic core.

The windings may be progressively wound around the spool. With this winding method, wires are wound in layers at an angle to reduce the number of turns between adjacent wires and thus keep the voltage potential low between two adjacent wires. A problem associated with this type of winding method is wire slippage between wire layers wound around the coil bobbin, which creates a large voltage potential between adjacent wires, resulting in wires shorting together. When wires are wound at an angle, the wires at the surface of the spool can slip and slide axially along the spool due to the tension and force that is in the wires above the surface of the spool. After slippage occurs wires will be wound on top of the slipped wire as the winding continues, resulting in a high wire to wire voltage when the coil is operated. There is a need to decrease wire slippage which is critical to maintain a high quality progressive winding.

SUMMARY OF THE INVENTION

The present invention provides an ignition coil that includes a magnetic core having opposite first and second ends. A primary winding is wound about the magnetic core between the first and second ends. A secondary winding is wound about a spool and is disposed about the primary winding and magnetic core. The second winding is inductively coupled to the primary winding. Alternatively, the primary winding may be wound around a spool and disposed about the secondary winding and the magnetic core. An outer case is disposed about the magnetic core and primary and secondary windings.

The spool includes a winding section between opposite first and second ends. There is a conical winding surface at one end of the spool that tapers from a larger diameter at the one end to a smaller diameter. A grooved surface extends axially toward another end of the spool and is connected with the smaller diameter. The grooved surface has longitudinally spaced continuous circular grooves. The grooves have unequally angled sides. The sides toward the one end are sloped at a greater angle relative to a radial direction than are the sides toward the other end. The secondary winding is wound around the winding section such that it forms a plurality of layers of turns of wire wound one over the other at a desired angle with one turn of the wire disposed within each groove.

The present invention provides a grooved surface on the secondary spool to prevent the layers of wire wound around the spool from slipping down in the axial direction. The grooves are designed to accommodate only one turn of wire. Thus, the maximum distance that a wire on the surface of the spool will slip is the distance from the crest to the trough of the groove. By having one side have a greater angle, a positive stop is created, preventing the wire from slipping away from the conical end of the spool where winding of the coil is initiated. By designing the coil with specific grooves, the voltage potential between adjacent wires may be more controlled and result in fewer secondary wire to wire shorts. Further, the grooved surface increases the surface area of the spool and improves the adhesion of the spool to an epoxy used to encapsulate the windings.

These and other features and advantages of the invention will be more fully understood from the following description of certain specific embodiments of the invention taken together with the accompanying drawings.

DESCRIPTION OF THE PREFERRED EMBODIMENT

Figure 1:
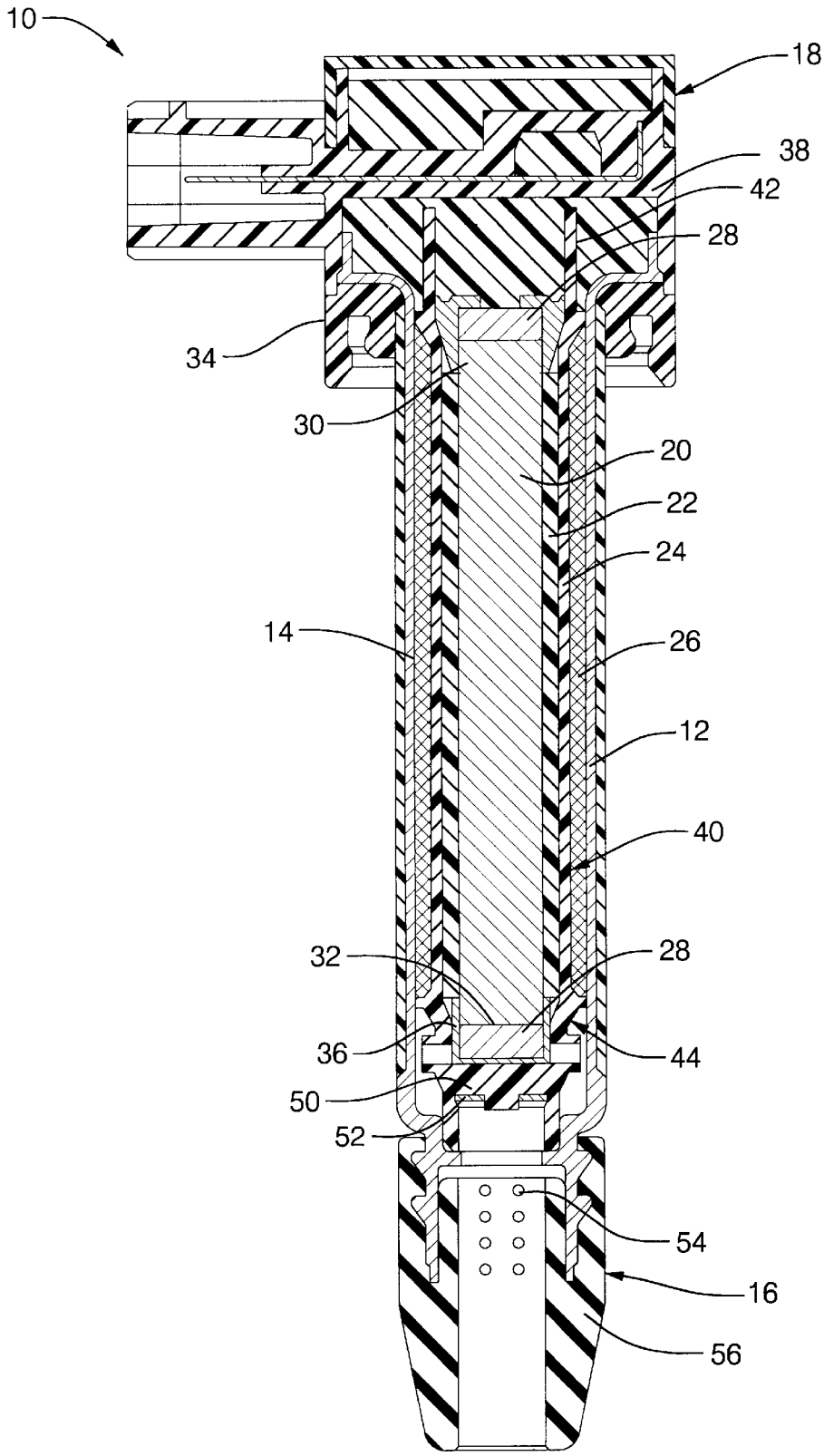
FIG. 1 is a cross-sectional view of an ignition coil in accordance with the present invention.

Referring now to FIG. 1 of the drawings in detail, numeral 10 generally indicates an ignition coil for an automotive vehicle. The ignition coil 10 is be to employed in an ignition system of an internal combustion engine to produce high voltage charges to spark plugs sufficient to result in a desired electric arc to initiate combustion within an engine cylinder. Ignition systems may employ a single ignition coil with mechanical or electronic distribution of the high voltage sequentially to multiple spark plugs in a multi-cylinder engine. Alternatively, the ignition system may employ a so-called pencil coil associated with each cylinder of a multi-cylinder internal combustion engine. The ignition coil 10 is a pencil coil for a system having a coil for each spark plug.

The ignition coil 10 generally includes a rigid insulating outer case 12 that encloses a transformer assembly 14. A spark plug assembly 16 is positioned at one end of the transformer assembly 14 for supplying voltage to a spark plug (not shown). A connector assembly 18 that includes a control circuit is positioned at another end of the transformer assembly for controlling the flow of primary current to the transformer assembly 14.

The transformer assembly 14 includes, coaxially arranged from the inside out, a magnetic core 20, a primary winding 22, a secondary spool 24, and a secondary winding 26. The magnetic core 20 is a cylindrical member having a circular cross section. Core 20 may be formed of composite iron powder particles and electrical insulating material, which are compacted or molded into the cylindrical member. The particles of iron powder are coated with the insulating material. The insulating material forms gaps, like air gaps, between the particles and also serves to bind the particles together. The final molded part may be, by weight, about 99% iron particles and 1% plastic material. By volume, the part may be about 96% iron particles and 4% plastic material. After the core 20 is molded, it is machine finished such as by grinding, to provide a smooth surface for direct winding of the primary winding 22 thereon. A coating of insulating material may be applied to the outside surface of the magnetic core to insulate it from the primary winding. Alternatively, the magnetic core 20 may be comprised of longitudinally extending laminated silicon steel strips. The strips may have a fixed length and a variety of widths to form a cylindrical member.

Permanent magnets 28 may be disposed on opposite ends 30,32 of the magnetic core 20 to increase the stored magnetic energy in the coil 10. The magnets 28 are disposed such that their magnetic fluxes are oriented opposite to the magnetic flux generated by the primary winding 22. Magnet 28 at end 30 is disposed within a cap 34 which is attached to the magnetic core 20. The other magnet 28 at end 32 is disposed within a cup 36.

The primary winding 22 is wound directly on the insulated surface of the magnetic core 20. The primary winding 22 may be comprised of two winding layers, each being comprised of 106 turns of No. 23 AWG wire. Application of the primary winding 22 directly upon the core 20 provides for efficient heat transfer of the primary resistive losses and improved magnetic coupling which is known to vary substantially inversely proportionally with the volume between the primary winding 22 and the core 20. This type of construction also allows for a more compact coil assembly. Alternatively, the primary winding 22 may be wound around a spool and disposed about the secondary winding 26 and the magnetic core 20.

The connector assembly 18 includes a connector body 38 that is molded to enclose primary terminals (not shown). The primary terminals are connected with the primary winding 22 to connect the primary winding 22 with a control circuit (not shown) that controls current flow to the primary winding 22.

Figure 2:
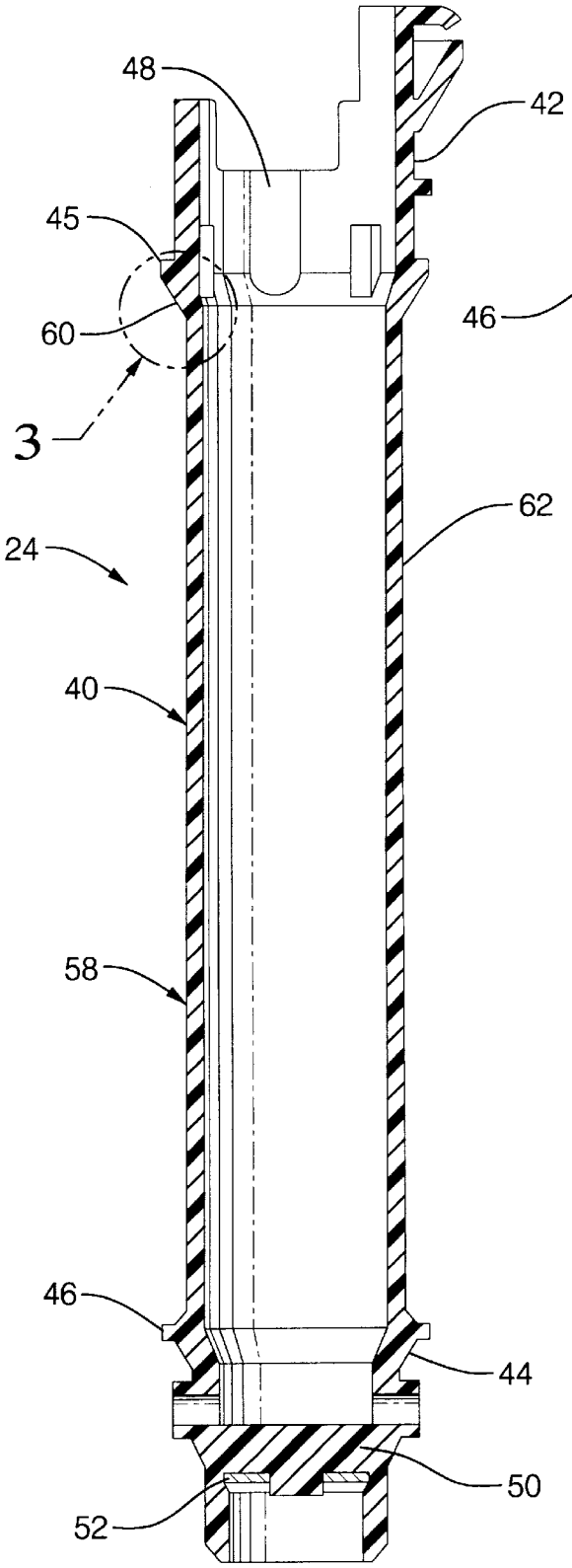
FIG. 2 is a cross-sectional view of a secondary spool used within the ignition coil of FIG. 1.

The secondary winding 26 is progressively wound around the secondary spool 24. The winding 26 is wound in layers at a desired angle. The secondary winding 26 may be comprised of 9010 total turns of No. 43 AWG wire. Referring to FIG. 2, spool 24 is a resin product formed into a cylindrical body 40 having a circular cross section and opposite ends 42,44. Flanges 45, 46 are provided inwardly adjacent ends 42,44, respectively.

A cylindrical portion 48 is formed on the end 42 of the spool 24. The cap 34 and the permanent magnet 28 are disposed within the cylindrical portion 48. Spool end 44 is substantially closed by a bottom portion 50. The cup 36 and permanent magnet 28 are enclosed in the bottom portion 50. A terminal plate 52 is fixed on the bottom portion 50 of the secondary spool 24. Plate 52 is connected to the secondary winding 26 through a lead wire (not shown). The terminal plate 52 is also connected to a spring clip 54 of the spark plug assembly 16. The spark plug assembly 16 includes a boot 56 enclosing the spark plug and the spring clip 54, which connects the spark plug to the secondary winding 26. A high-voltage output, when induced in secondary winding 26, is supplied to the electrode of the spark plug via the terminal plate 52, and spring clip 54.

A winding section 58 extends between flanges 45,46 and includes a conical winding surface 60 that is formed adjacent end 42 of spool 24. The conical winding surface 60 tapers from a larger diameter adjacent end 42 to a smaller diameter. The smaller diameter is connected with a grooved surface 62 extending axially toward end 44 of the spool 24.

Figure 3:
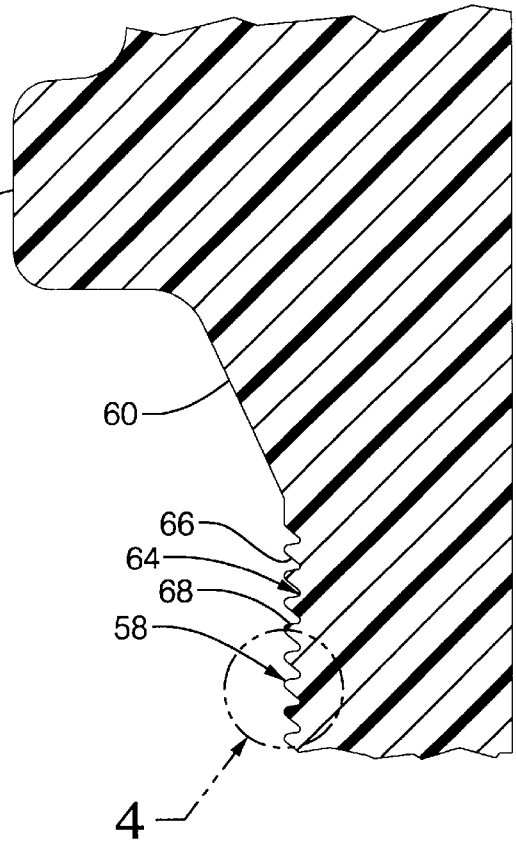
FIG. 3 is an enlarged view of a portion of the secondary spool in FIG. 2.
Figure 4:
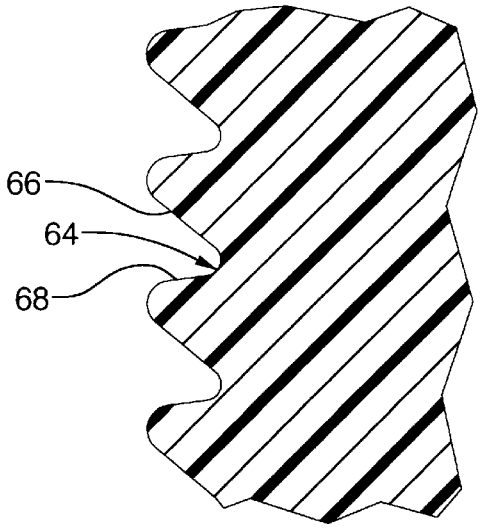
FIG. 4 is an enlarged view of the grooved surface of secondary spool of FIG. 3.

Referring to FIGS. 3 and 4, the grooved surface 62 contains longitudinally spaced continuous circular grooves 64. The grooves 64 generally have a sawtooth shaped cross section with unequally angled sides 66,68. The sides 66 toward end 42 are sloped at a greater angle relative to a radial direction than are sides 68 toward the other end 44. In one embodiment, the greater angled sides 66 form an angle of approximately 45° from the normal to the surface of the spool 24 and the other sides 68 form an almost radial smaller angle of approximately 5° from the normal to the surface of the spool 24 as shown in FIG. 3.

The smaller angled sides 68 provide a stop that the wire engages to prevent the wire from slipping away from the conical end where the coil winding is initiated. The height and width of the grooves 64 is such that only one turn of the secondary winding 26 is accommodated in each groove 64. Thus, the maximum distance a wire wound on the surface of the spool 24 can slip is the distance from the crest to the trough of the groove. The groove configuration of the present invention lowers the risk that a large voltage potential between two layers of wire will occur resulting in the shorting of the wires together.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An ignition coil for a spark ignition engine comprising:

a magnetic core having opposite first and second ends;

a primary winding wound about said magnetic core between the first and second ends;

a spool defining a winding section including a conical winding surface at one end of the spool tapering from a larger diameter at said one end to a smaller diameter, said smaller diameter connecting with a grooved surface extending axially toward another end of the spool and containing longitudinally spaced continuous circular grooves, said grooves having unequally angled sides wherein sides toward said one end are sloped at a greater angle relative to a radial direction than are sides toward said other end;

a secondary winding wound around the winding section forming a plurality of layers of turns of wire wound one over the other at a desired angle, the grooves being sized such that only one turn of the wire is disposed within each groove, said secondary winding being inductively coupled to the primary winding; and an outer case disposed about said magnetic core, and primary and secondary windings.

2. An ignition coil as in claim 1 wherein the magnetic core is a cylindrical member having a circular cross section.

3. An ignition coil as in claim 1 wherein the magnetic core is insulated and the primary winding is wound directly on the insulated core.

4. An ignition coil as in claim 1 wherein the primary winding is wound directly on a spool and said primary winding is disposed about the secondary winding and the magnetic core.

5. An ignition coil as in claim 1 wherein the greater angled sides form an angle of approximately 45° from the normal to the surface of the spool and the other sides form an angle of approximately 5° from the normal to the surface of the spool.

6. A spool assembly for an ignition coil comprising:

a cylindrical body having opposite first and second ends;

a winding section between said ends;

a conical winding surface at one of said ends tapering from a large diameter at said one end to a smaller diameter;

a grooved surface extending axially between another of said ends of the body and the smaller diameter and containing longitudinally spaced continuous circular grooves, said grooves having unequally angled sides wherein sides toward said one end are sloped at a greater angle relative to a radial direction than are sides toward said other end; and a winding wound around the winding section forming a plurality of turns of wire wound one over the other at a desired angle, the grooves being sized such that only one turn of the wire is disposed within each groove.

7. A spool assembly as in claim 4 wherein the greater angled sides form an angle of approximately 45° from the normal to the surface of the spool and the other sides form an angle of approximately 5° from the normal to the surface of the spool.

* * * * *